US009142349B2

(12) United States Patent
Wang et al.

(10) Patent No.: US 9,142,349 B2
(45) Date of Patent: Sep. 22, 2015

(54) METHOD FOR ACHIEVING CONVERTER TRANSFORMER FOR DC MAGNETIC BIAS

(75) Inventors: Jian Wang, Shenyang (CN); Guiping Li, Shenyang (CN); Yong Sun, Shenyang (CN); Zhikai Ma, Shenyang (CN)

(73) Assignee: TBEA SHENYANG TRANSFORMER GROUP CO., LTD., Shenyang, Liaoning (CN)

( * ) Notice: Subject to any disclaimer, the term of this patent is extended or adjusted under 35 U.S.C. 154(b) by 482 days.

(21) Appl. No.: 13/380,815

(22) PCT Filed: Jun. 26, 2009

(86) PCT No.: PCT/CN2009/072483

§ 371 (c)(1),
(2), (4) Date: Dec. 24, 2011

(87) PCT Pub. No.: WO2010/148575

PCT Pub. Date: Dec. 29, 2010

(65) Prior Publication Data

US 2012/0090164 A1 Apr. 19, 2012

(51) Int. Cl.
*H01F 3/00* (2006.01)
*H01F 41/02* (2006.01)

(52) U.S. Cl.
CPC ..... *H01F 41/0233* (2013.01)

(58) Field of Classification Search
CPC ..... H01F 3/02; H01F 3/04; H01F 27/12; H01F 27/245; H01F 27/25; H01F 27/263; H01F 27/266; H01F 41/02; H01F 41/0213; H01F 41/0233
USPC ..... 29/417, 592.1, 602.1, 604–606; 336/200, 234
See application file for complete search history.

(56) References Cited

U.S. PATENT DOCUMENTS

| | | | | |
|---|---|---|---|---|
| 4,140,987 | A * | 2/1979 | Maezima | 336/60 |
| 5,777,537 | A * | 7/1998 | Allen et al. | 336/96 |
| 6,070,317 | A * | 6/2000 | Allen et al. | 29/609 |
| 7,199,696 | B2 * | 4/2007 | Pauley et al. | 336/234 |
| 7,256,677 | B2 * | 8/2007 | Pauley et al. | 336/212 |
| 7,877,861 | B2 * | 2/2011 | Pauley et al. | 29/606 |
| 7,882,615 | B2 * | 2/2011 | Pauley et al. | 29/602.1 |
| 7,978,044 | B2 * | 7/2011 | Takeuchi et al. | 336/216 |
| 2006/0226947 | A1 * | 10/2006 | Pauley et al. | 336/234 |

* cited by examiner

*Primary Examiner* — Paul D Kim
(74) *Attorney, Agent, or Firm* — Raymond Y. Chen; David and Raymond Patent Firm

(57) ABSTRACT

A method for achieving converter transformer for suppressing DC bias magnet comprises increasing the seaming width of the transformer core lamination, which comprises in detail calculating the width and the height of each stage of lamination according to the reserved seaming width of the lamination, the sectional area of the core, the space between columns, and the height of the window, shearing the lamination based on the width and the height of the lamination obtained by calculating, overlapping two pieces of laminations into one piece of lamination according to the order of stages, placing them on the core frame alternately by stages, and after overlapping all the laminations, fastening each stage of lamination.

6 Claims, 3 Drawing Sheets

B-B (C-C Rotation)

A-A

D-D

E-E

B-B (C-C Rotation)

A-A

D-D

E-E

METHOD FOR ACHIEVING CONVERTER TRANSFORMER FOR DC MAGNETIC BIAS

BACKGROUND OF THE PRESENT INVENTION

1. Field of Invention

The present invention relates to a manufacture method of a transformer, and more particularly to a converter transformer with DC magnetic bias inhibition arrangement which is applicable for capacitance of different values.

2. Description of Related Arts

DC grid and geomagnetic variation are factors which increase a neutral ground point of a transformer, causing a DC bias current flowing into a coil of the transformer through the neutral and result in half-cycle saturation of magnetizing current of the transformer.

In the absence of DC current in a coil assembly of a transformer, no load current works in the linear segment of the iron-core magnetization curve Φ (t). At this point, the magnetizing current basically is a sine wave or approximately a sine wave which is symmetrical in shape, as shown by the solid line in FIG. 1(*c*). Under the influence of DC magnetic bias, which is shown in the broken line of FIG. 1(*c*), a shift is occurred to the exciting current under no-load condition in the iron-core magnetization curve Φ (t) in which the half wave works in the saturation zone, an elevated peak is occurred, and the sine wave is distorted to become asymmetrical from its originally symmetrical form.

Due to the half cycle saturation phenomenon which is occurred in the core, a large amount of saturated magnetic flux linkage forms a closed loop path outside the core, the exciting current is distorted dramatically, thereby the transformer itself will have increased wear and tear under no load condition and increased level of oscillation, increased noised level. In addition, the core, metal parts and oil tank of the transformer will become overheat while the insulation element will be damaged. When the situation is serious, the electric power system will be jeopardized and the power grid may be collapsed.

SUMMARY OF THE PRESENT INVENTION

In view of the problems in the convention technology, the present invention is to provide a converter transformer with DC magnetic bias such that the effect of DC magnetic bias effect is decreased.

Additional advantages and features of the invention will become apparent from the description which follows, and may be realized by means of the instrumentalities and combinations particular point out in the appended claims.

According to the present invention, the foregoing and other objects and advantages are attained by a method inhibiting DC magnetic bias of a converter transformer, wherein the converter transformer includes an iron core unit which comprises a plurality of laminate units integrally connected forming the core unit defining a joint portion between the two adjacently connected laminate units; and a core frame supporting the core unit, comprising the steps of: increasing a width of the joint portion of each of the laminate units of the core unit with the following sub-steps:

defining a preset number of levels of laminate unit for the iron core unit, determining a width and a height of the laminate unit for each of the levels through computing a width of the joint portions of the laminate units required for reserve, a cross-section of the core unit, a column spacing of the core unit and a height of a window of the core unit;

cutting each of the laminate units according to the width and the height of each of the laminate units obtained from the above step;

aligning the laminate units in such a manner that two of the laminate units of the same level are overlapped to form one coupled unit of laminate units, and each of the coupled unit of laminate units belonging to different levels are sequentially overlapped and positioned such that the coupled unit of different levels are provided in an alternate position on the core frame; and mounting the laminate units into position after placing the laminate units in order.

The width of the joint portion of each of the laminate units of the core unit is not less than a standard deviation thereof and is not greater than a center distance of the joint portion between the two adjacently connected laminate units; the joint portion is defined as a portion between a lower yoke and a main column of the core unit, and a portion between the lower yoke and a side column of the core unit; the joint portion is defined as a portion between an upper yoke and a main column of the core unit, and a portion between the upper yoke and a side column of the core unit; the mounting of the laminate units is achieved by providing a positioning hole to each of the laminate units and penetrating a screw unit through the positioning hole of the laminate unit to mounting the laminate units into position; the mounting of the laminate units is achieved by bonding the laminate units with adhesive element; the preset number of level of laminate units is 1~6.

The advantageous effect and function of the method of the preferred embodiment of the present invention are the followings:

1. Decrease the disadvantageous effect of DC bias current to the transformer. According to the present invention, a resistance to DC bias magnetic flux generated by DC current is increased through reserving a width to the joint portion of the laminate units, thereby increasing the no load current of the transformer, reducing the DC magnetic bias of the transformer which includes reducing the increasingly high level of oscillation phenomenon, reducing the increase of noise level, reducing the overheat possibility of the iron core, metal structural parts and oil tank, etc. of the transformer, and even reducing the possible damage to the insulation parts.

2. Effectively reduce the harmful effect to the electric power system. In reducing the effect of DC bias current and magnetic flux to the transformer, the adverse effect and damaging effect to the electric power system due to the transformer being affected by bias current and magnetic flux are reduced.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Exemplary Embodiment 1

Figure 1:
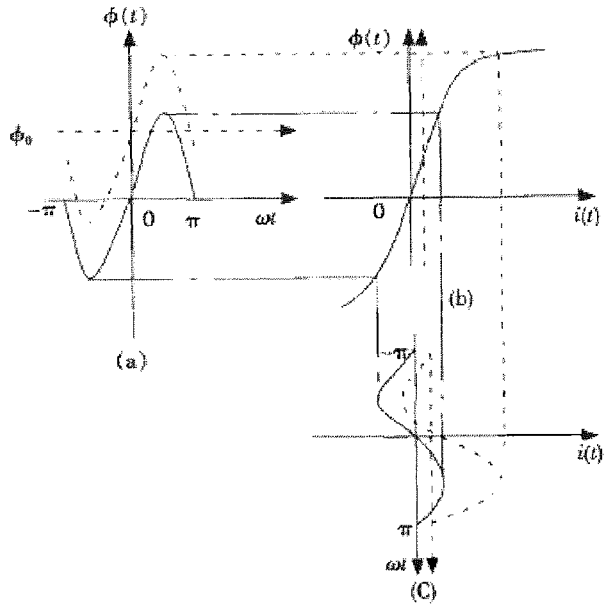
FIG. 1 is a curve showing an effect of DC current to exciting current of transformer in the conventional art.

According to the preferred embodiment of the present invention, the method is applied in a transformer with an iron core unit and side column so as to increase a width of a joint portion (seaming width) of each laminate unit of the core unit of the transformer (transformer core lamination). In particular, the method comprises the following steps:

defining a preset number of levels (stages) for the iron core unit, determining a width and a height of the laminate unit for each of the levels of the iron core unit through computing a reserved width of the joint portions of the laminate units, a cross-section of the core unit, a column spacing between the columns of the core unit and a height of a window of the core unit;

cutting each of the laminate units according to the width and the height of each of the laminate units obtained from the above step;

aligning the laminate units in such a manner that one of the laminate units of each of the levels are overlapped and positioned in sequence and in order to form one set of laminate units, wherein a preset number of the set of laminate units are aligned in an overlapped manner on the core frame; and positioning the set of laminate units and mounting the laminate units into position.

The width of the joint portion of each of the laminate units of the core unit is not less than a standard deviation thereof and is not greater than a center distance of the joint portion between the two adjacently connected laminate units.

Referring to FIGS. 2A to 2E of the drawings, according to the preferred embodiment of the present invention, the iron core unit is a single-phase four-column core which includes two main columns 1, two side columns 2, three upper yokes 3, and three lower yokes 4. The core unit has an appearance similar to a conventional single-phase four-column iron core. The important feature of this embodiment is the characteristic positions of the joint portions which are enlarged, which are set between the upper yoke 3 and the main column 1, the upper yoke 3 and the side column 2 (can also be between the lower yoke 4 and the main column 1, the lower yoke 4 and the side column 2). The total number of enlarged joint portions (which is four in this embodiment) is half of the total number of joint portions (which is eight in this embodiment). It is also possible to apply the enlarged joint portions to all the joint portions. In this embodiment, the iron core unit employs a two-level (stage) joint connection method (but it is also possible to provide a 3~6 level (stage) joint connection). The iron core unit has positioning holes 7 on each of the laminate units at preset position so as to ensure that the characteristic positions of the joint portions, which are between the columns and yokes, are restricted to the required dimensions and parameters.

Figure 2A:
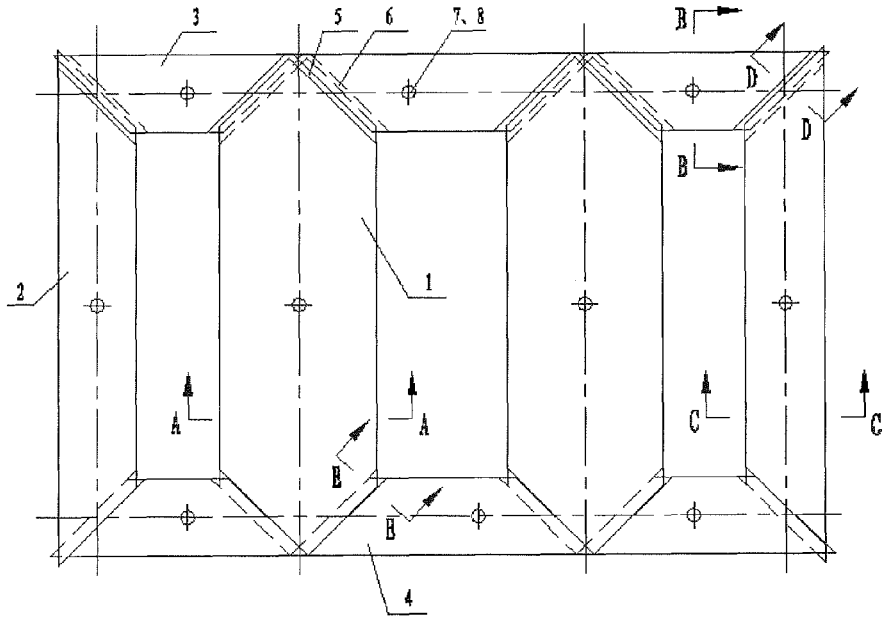
FIG. 2A is a front view of a joint portion according to the first exemplary embodiment of a preferred embodiment of the present invention.
Figure 2B:
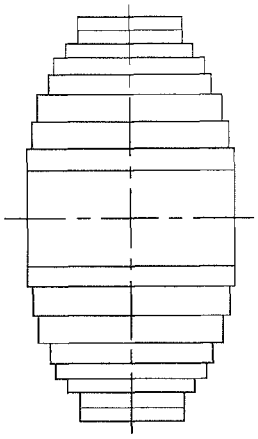
FIG. 2B is a B-B cross-section view of FIG. 2A according to the above first exemplary embodiment of the above preferred embodiment of the present invention.
Figure 2C:
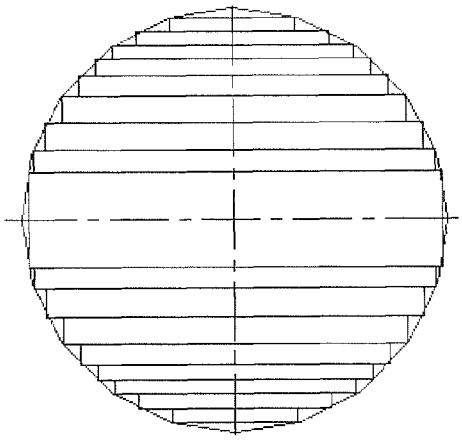
FIG. 2C is an A-A cross-section view of FIG. 2A according to the above first exemplary embodiment of the above preferred embodiment of the present invention.
Figure 2D:
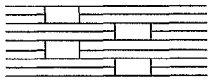
FIG. 2D is a D-D cross-section view of FIG. 2A according to the above first exemplary embodiment of the above preferred embodiment of the present invention.
Figure 2E:
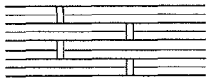
FIG. 2E is an E-E cross-section view of FIG. 2A according to the above first exemplary embodiment of the above preferred embodiment of the present invention.
Figure 3A:
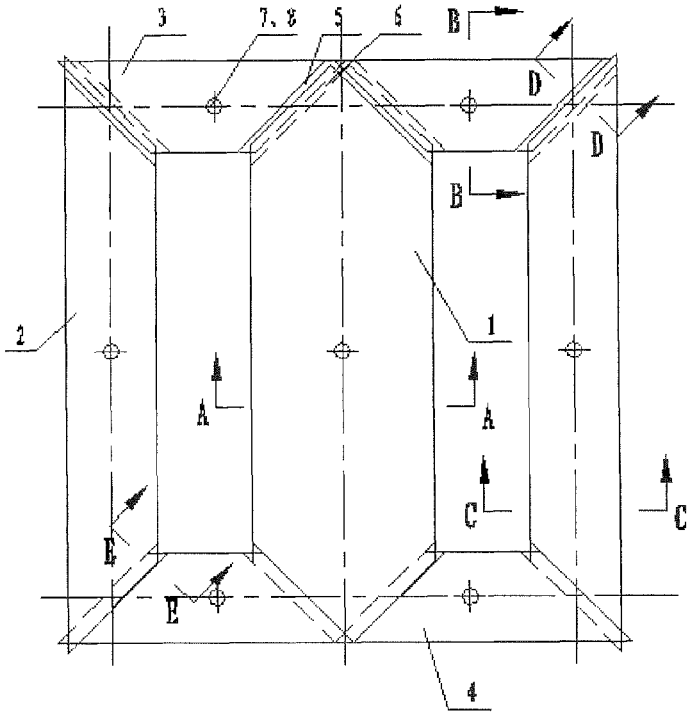
FIG. 3A is a front view of a joint portion according to the second exemplary embodiment of a preferred embodiment of the present invention.
Figure 3B:
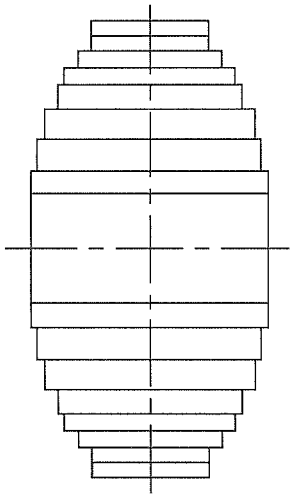
FIG. 3B is a B-B cross-section view of FIG. 3A according to the above second exemplary embodiment of the above preferred embodiment of the present invention.
Figure 3C:
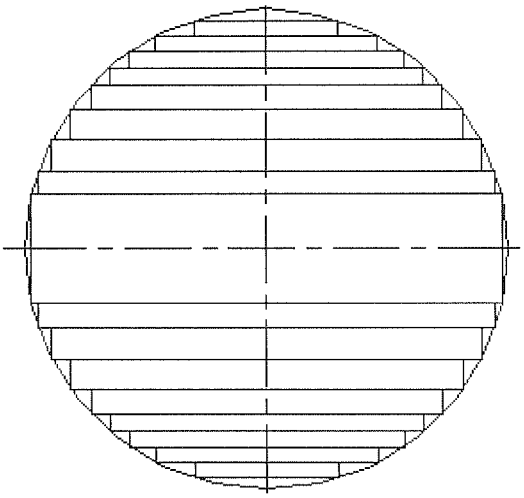
FIG. 3C is an A-A cross-section view of FIG. 3A according to the above second exemplary embodiment of the above preferred embodiment of the present invention.
Figure 3D:
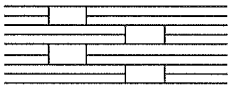
FIG. 3D is a D-D cross-section view of FIG. 3A according to the above second exemplary embodiment of the above preferred embodiment of the present invention.
Figure 3E:
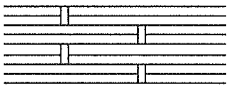
FIG. 3E is an E-E cross-section view of FIG. 3A according to the above second exemplary embodiment of the above preferred embodiment of the present invention.

FIG. 2D is a sectional view of FIG. 2A at a D-D direction showing a critical position according to the preferred embodiment of the present invention, which is an illustration of a position of the enlarged joint portion. FIG. 2E is a sectional view of FIG. 2A at a E-E direction, which is an illustration of a position of a joint portion in the prior art. When comparing the joint portions in FIGS. 2D and 2E, it is clear that the joint portion at the D-D direction is specifically designed to provide a preset distance which is far greater than the distance which is allowed in the E-E direction. In the remaining figures, FIG. 2C is a sectional view of FIG. 2A at an A-A direction, which is a sectional view of the main column; FIG. 2B is a sectional view of FIG. 2A at a B-B direction (or a rotational view at a C-C direction from a rear view), which is a sectional view of the upper yoke (or side column); the figures also show the positions of a first-level connecting joint portion 5 and a second-level connecting joint portion 6, and the illustrative positions of the positioning hole 7 and the screw unit 8.

The iron core unit is formed by laminate units of different levels and different width. Each of the laminate units belonging to the same level is determined to have a preset size and shape according to the relative positions of the main column 1, the side column 2, the upper and the lower yokes 3, 4 through calculation (including computing a width of the joint portion, a sectional area of the iron core, a column spacing, and a height of a window). When cutting, laminate units of the same level are cut into two types of laminate units based on a two-level connection requirement. Then, the laminate units of different levels are overlapped in sequence and in order.

In this embodiment, one set of laminate units has two laminate units in which the first level connecting joint portion 5 and the second level connecting joint portion 6 are alternately positioned. When placing the laminate units into position, the critical characteristic according to the preferred embodiment of the present invention, the joint portion which is increased, is ensured to has a reserved width requirement in which the width of the joint portion is not less than a standard deviation and is not larger than a center distance of the joint portion between two adjacently positioned laminate units of two different levels. In this embodiment, the width is 5 mm.

According to the present invention, a positioning means such as a positioning hole 7 is used to ensure that position of the laminate units are accurate. After the laminate units of different levels are aligned into position, a screw unit 8 is used to penetrating the positioning hole to secure the laminate units into position. If the upper yoke is to be removed to facilitate installation of coil, the upper yoke has to be placed in the original position after the coil is installed; thereby the provision of the positioning means ensure the requirement of the spacing between joint portions is met. For core without upper yoke, the upper yoke can be placed into position after the coil is installed such that the requirement of the spacing between joint portions is met.

The feature of the present invention is applied in a converter transformer to increase a resistance to DC bias current generated by the converter transformer. In other words, in some or all of the joint portions of an iron core, a width of the joint portion between laminate units is increased. Since the distance at the joint portion between laminate units is increased, the resistance to the DC bias current generated by the converter transformer is increased, thereby a no load current of the converter transformer is increased. Accordingly, the bias magnetic flux of the transformer is reduced and hence the advantageous effect of removing the harmful effect of DC bias current on the transformer is achieved.

Embodiment 2

Referring to FIGS. 3A to 3E of the drawings, the difference from the exemplary embodiment 1 is that the iron core unit is a single-phase three columns unit which includes one main column 1, two side columns 2, two upper yokes 3, two lower yokes 4, wherein the number of joint portions is 6, all of which employed the enlarged joint portions. Still, one set of laminate units includes two laminate units, the first level connecting joint portion 5 and the second level connecting joint portion 6 are alternately positioned. The laminate units are mounted into position by employing positioning hole 7 and screw unit 8.

According to the different requirements of different converter transformer, the laminate units of different levels can be place alternately with 1 to 6 level of laminate units, the mounting of laminate units can also employ other method such as boding with bonding element or tying with strap element.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A method for making a transformer, comprising the steps of:

(a) connecting a plurality of laminate units to form a core unit by the steps of:

alignedly overlapping said laminated units in such manner that each two of said laminate units of the same level are overlapped to form a coupled unit of laminate units wherein said coupled units of laminate units are configured at different levels; and sequentially overlapping said coupled units of laminate units at said different levels in an alternating manner to couple said coupled units of laminate units with each other;

(b) configuring said core unit to have at least a main column, two side columns, two upper yokes, and two lower yokes;

(c) defining a plurality of joint portions between said upper yokes and said main column, between said upper yokes and said side columns, between said lower yokes and said main column, and between said lower yokes and said side columns;

(d) reserving a seaming width at each of said joint portions for decreasing a DC magnetic bias effect; and (e) providing a positioning hole at each of said laminate units to secure said laminate units together via a screw unit for ensuring said seaming width to be retained at each of said joint portions.

2. The method, as recited in claim 1, wherein said seaming width is approximately 5 mm.

3. The method, as recited in claim 2, wherein said positioning holes are provided at said main column, said side columns, said upper yokes, and said lower yokes respectively.

4. The method, as recited in claim 3, wherein a number of levels of said laminate units is 1~6.

5. The method, as recited in claim 1, wherein said positioning holes are provided at said main column, said side columns, said upper yokes, and said lower yokes respectively.

6. The method, as recited in claim 1, wherein a number of levels of said laminate units is 1~6.

* * * * *